US005184530A

United States Patent [19]

Galat

[11] Patent Number: 5,184,530

[45] Date of Patent: Feb. 9, 1993

[54] OFFSET GEARED NUTRUNNER ATTACHMENT

[76] Inventor: Donald E. Galat, 29716 Oakgrove, St. Clair Shores, Mich. 48082

[21] Appl. No.: 656,757

[22] Filed: Mar. 4, 1991

[51] Int. Cl.[5] ..... B25B 17/00

[52] U.S. Cl. ..... 81/57.21; 81/57.3

[58] Field of Search ..... 81/57.2, 57.21, 183, 81/57.3

[56] References Cited

U.S. PATENT DOCUMENTS 3,988,952 11/1976 Dirks ..... 81/57.21 X 4,729,269 3/1988 Killian ..... 81/57.21 X

FOREIGN PATENT DOCUMENTS 2644865 4/1978 Fed. Rep. of Germany ..... 81/57.2

*Primary Examiner*—James G. Smith

[57] ABSTRACT

A powered wrenching tool adaptable to be powered by any reversible drive mechanism is formed with a support for drive wheels and idler wheels with the idler wheels being movable with respect to the drive wheels, to adjust the tool for differing diameters of objects to be rotated. The tool is adapted to interface to the axis of the diameters of objects. The drive wheels engaging the objects without requiring the tool to circumscribe the object. The rotational axis of idler wheels and the drive wheels are positioned above and below with respect to each other. The upper and lower wheels are clamped together on the diameter by the handle on the tool. The tool is adapted on one side to have the drive source attached. Only the wheels of the tools are rotated and the tool neeed not rotate with respect to the diameter to be rotated.

3 Claims, 4 Drawing Sheets

OFFSET GEARED NUTRUNNER ATTACHMENT

FIELD OF INVENTION

This invention relates the tools and equipment for rapid adjustment of automotive steering tie rods to align the toe-in/toe-out of the front wheels and make micro adjustments to meet the required specifications.

BACKGROUND OF THE INVENTION

The powered wrenching tool is used for wheel alignments in the automotive assembly plants and other wheel alignment service locations.

Currently used are held hand wrenches (pipe, chain, pac-man style) which are time consuming and physically debilitating. The only alternative available is capital equipment which is expensive in special design, installation, and maintenance.

The need for a powered tool is not solely based on a labor saving principle of reducing the amount of hand energy that must be used. There has developed a need for a tool to be used where limited space is available for the rotation of a wrenching tool.

In some powered rotating tools it is necessary that one or more elements of the tool rotate around the object. The space limitation that prevents the use of such powered rotating tool is the space at either side, parallel, and behind the object.

An object of the present invention is to provide a powered wrenching tool that is adapted for faster application.

Another object of the present invention in accord with the preceding objects is a powered wrenching tool that provides easy interfacing with convenient adjustment means for adapting the tool to varying diameters of the application.

A further object of the present invention in accord with the preceding objects is a powered wrenching tool that is adapted to have its power source reversible to side of the tool with the rotating elements of the tool adapted for rotation in either direction.

Another object of the present invention in accord with the preceding objects is a powered wrenching tool wherein the tool is easily interfaced to the diameter to be rotated.

Further objects and features of the invention will be readily apparent to those skilled in the field of invention. The appended drawings and specification illustrating the preferred embodiments.

SUMMARY

The powered wrenching tool can provide (approximately) a 90% savings in cost of the alternative, which is special designed capital equipment. The tool is readily adaptable and attachable to present alignment equipment. In general, this tool provides for a faster and accurate wheel alignment with less cost, and less physical stress on the employee.

DETAILED DESCRIPTION OF THE ILLUSTRATED PREFERRED EMBODIMENTS

Figure 1:
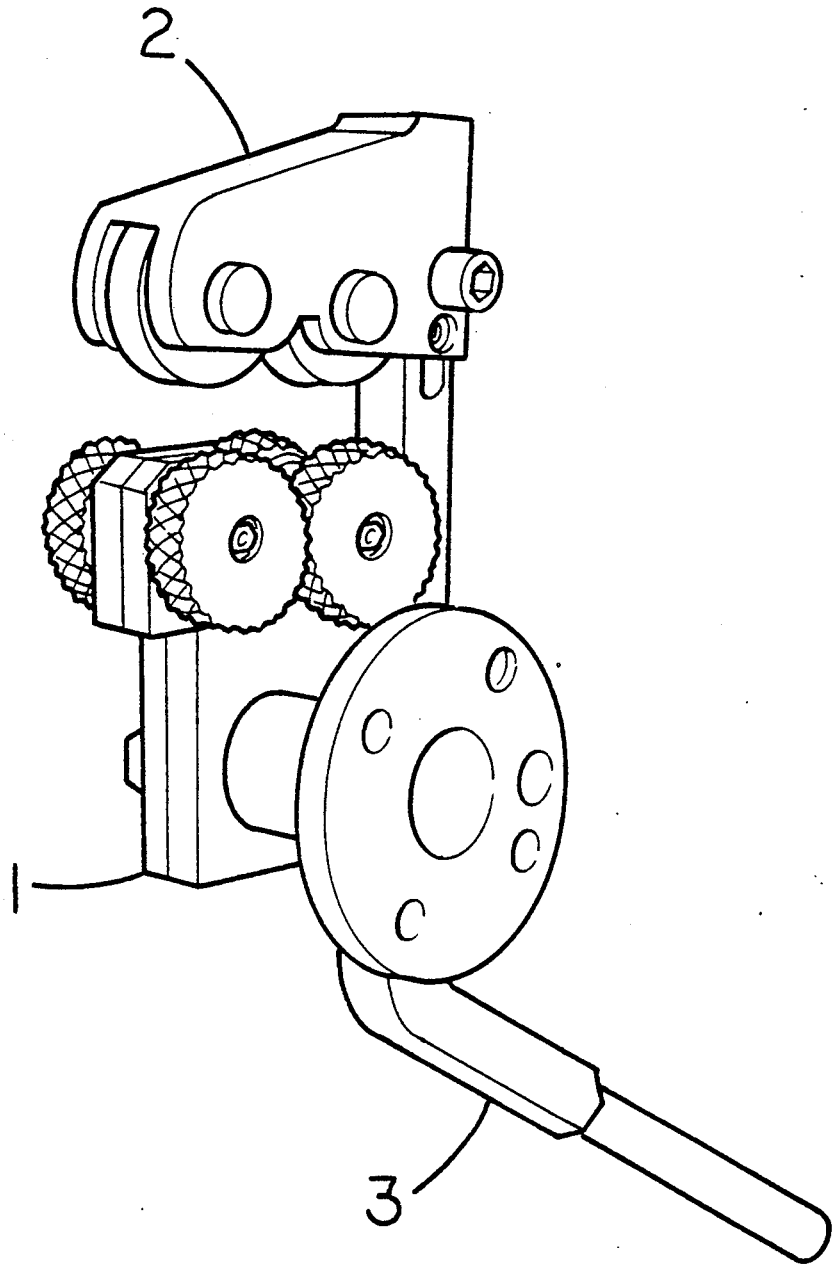
FIG. 1 is a perspective view of the powered wrenching tool of the present invention.

The powered wrenching tool of the present invention is illustrated in (FIG. 1) in its assembled form as it might be used to adjust steering rods for toe-in and toe-out of vehicle wheels. Two such tools may be adjustably mounted on alignment service equipment. The tool itself comprises an offset gear box drive assembly (1), a upper idler rollers assembly (2), and a welded handle assembly (3). One application for use of the tool, is accomplished by moving the handle assembly upward against the hinged gear box assembly locking the spring plunger screw into the detent on end of the clevis, then using the top adjusting screw forcing the upper roller assembly and work piece down on the knurled wheels, then tightening the opposing two screws to clamp the upper roller case tight to the sides of the handle assembly. For repetitive operations for the same diameter workpiece, apply the tool by moving the handle upward, and disengage the tool by moving the handle downward.

Figure 2:
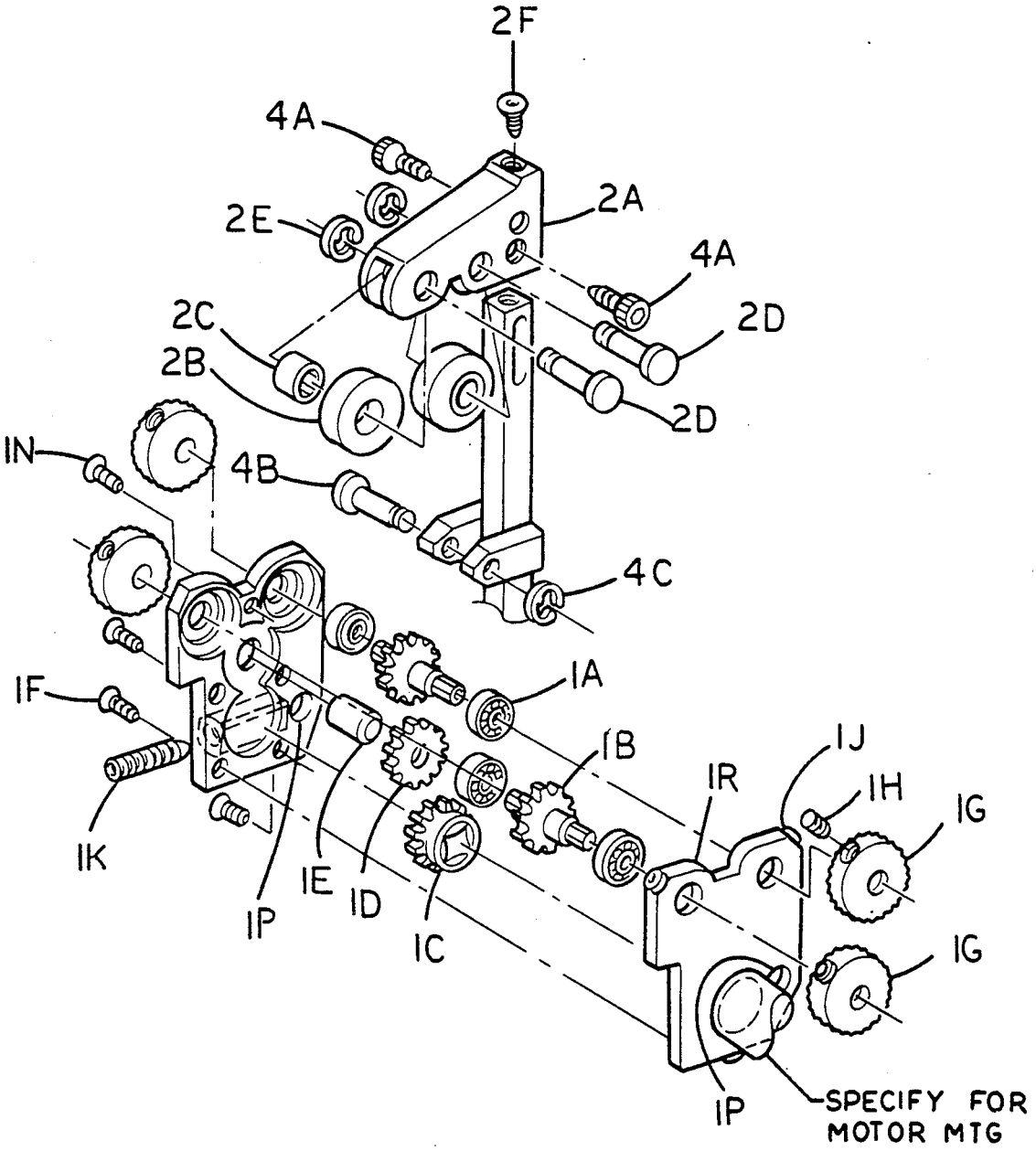
FIG. 2 is a exploded view showing all of the components of the powered wrenching tool.
Figure 3:
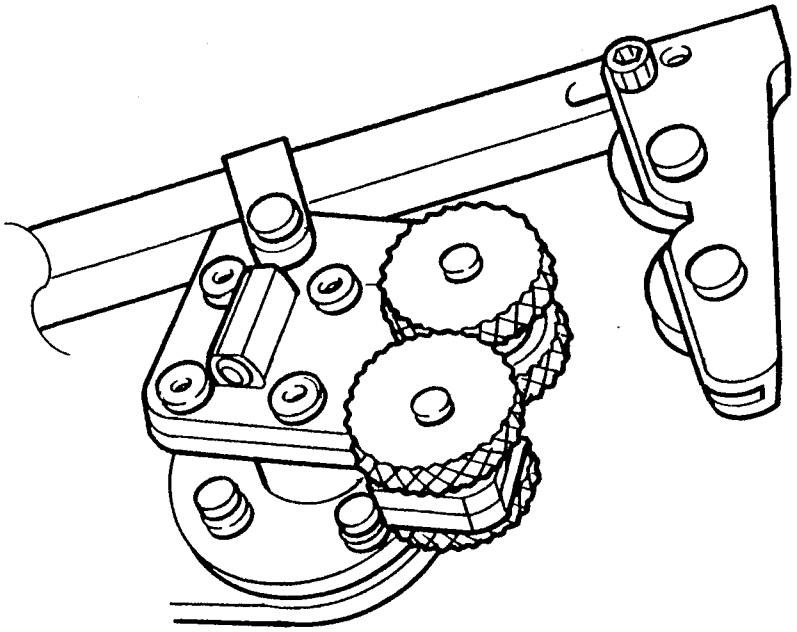
FIG. 3 is a left side perspective view of the powered wrenching tool of the present invention which illustrates a (standard) weldment case for the upper idler roller assembly.
Figure 4:
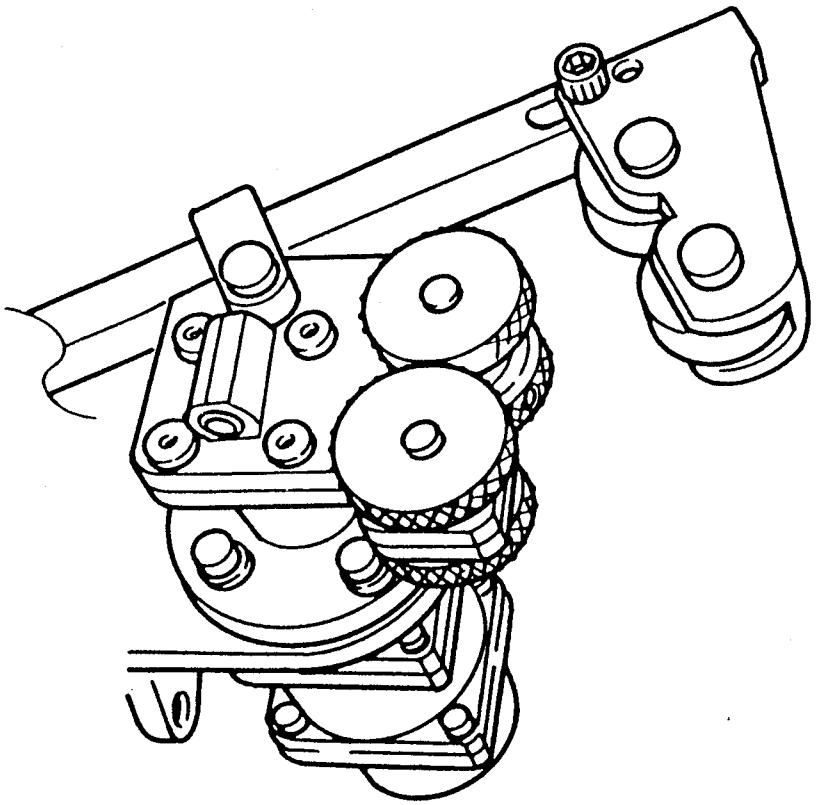
FIG. 4 is a left side perspective view of the powered wrenching tool of present invention which illustrates a (short) weldment case for the upper idler roller assembly with a power source attached.

The offset gear box drive assembly as illustrated in (FIG. 2) comprises two quality tool steel side frames (1R,1L) with two cavities in each frame into which four ball bearings (1A) are fitted, two shafted gears (1B), driving gear (1C), idler gear (1D), idler gear shaft (1E), all of which is assembled in and between the two side frames (1R,1L) fasten together by screws (1F,1N). The four knurled wheels (1G) are affixed on the extended shafts of the shafted gears and retained by four set screws (1H). The three grease fittings (1J) are assembled with two at the top and one in the bottom side frame (1R). The gear box mounting holes (1P) in each side frame provides a means for mounting the handle assembly to the gearbox by a mating shaft (4B) and retainer ring (4C). The adjustable spring plunger screw (1K) is assembled into a small housing which is welded on the outer side of (1L) to service the latch in order to lock the handle in a closed position against the gear box frame (Reference FIG. 4). A suitable mounting attachment (1M) may be chosen to accommodate any power source assembly.

The upper idler rollers assembly (2) as illustrated in (FIG. 2) (top view) comprises a quality tool steel weldment case (2A), two high durometer rubber wheels (2B) into each is installed a sleeve bearing (2C), two grooved steel roller shafts (2D) and two retainer rings (2E), at top of case is a readily accessible adjustment screw (2F) for adjusting the wrenching tool to receive multiple work diameters.

The handle assembly (3) as illustrated in (FIG. 2) comprises a handle member (straight or reshaped as required) with two welded clevis members which are indented on the protruding end and milled on the lower side edge for latching positions for the offset gear box drive assembly.

The upper idler roller assembly (2) is mounted to the upper end of the handle assembly (3) with two socket head screws (4A). The offset gear box drive assembly (1) is mounted to the handle at the clevis members with a mating shaft (4B) and a retainer ring (4C).

While certain preferred embodiments of the invention have been specifically disclosed, it should be understood that the invention is not limited. Many variations will be apparent to those skilled in the art. The invention is to be given its broadest possible interpretation within the terms of the following claims.

I claim:

1. A power operated tool for use in adjusting vehicle tie rods comprising:

a gear box frame having left and right portions, each portion having two cavities on an inner surface thereof adjacent to one end of the portions, a second cavity positioned below and in communication with each of said two cavities, a third cavity adjacent another end of the portions and in communication with the second cavity;

a set of driven gears secured to appropriate gear shafts and mounted in the two cavities, one in each of the cavities, an idler gear mounted in the second cavity for engagement with each of the driven gears, a driving gear mounted in the third cavity and in engagement with the idler gear for providing driving torque to the idler gear and to the driven gears; the driving gear extending through one of the frame portions for attachment to a power source;

a knurled wheel mounted to each driven gear shaft, one on each end of the shaft;

a handle assembly having an elongated handle member and a pair of clevis members, an aperture in each of the clevis members;

the gear box frame having opposing apertures in each frame portion that are aligned with the apertures in each of the clevis members, a retaining means to pivotally mount the gear box frame to the handle assembly; said retaining means fitting into the apertures in the clevis members and the apertures in the frame portions;

an upper idler assembly mounted on an end of the handle in opposition to the gear box frame, a pair of wheels mounted on the upper idler assembly in a position opposite to the knurled wheels;

biasing means on the gear box frame to secure the gear box frame in either a working or disengaged position.

2. A power tool as recited in claim 1 further comprising grease fittings in the gear box frame.

3. A power tool as recited in claim 1 wherein said biasing means comprises a spring secured within a housing mounted on one frame portion and a plunger screw securing the spring within the housing.

* * * * *